United States Patent [19]

Kobayashi et al.

[11] 4,417,803

[45] Nov. 29, 1983

[54] PRESSURE FIXING DEVICE

[75] Inventors: Masato Kobayashi; Yasushi Hoshino; Kazuyoshi Tateishi, all of Yokosuka; Minoru Isobe, Tokyo; Hiroshi Konishi, Tokyo; Yoshitomo Koga, Tokyo; Shigemi Hagiwara, Tokyo, all of Japan

[73] Assignee: Oki Electric Industry Co., Ltd., Tokyo, Japan

[21] Appl. No.: 382,152

[22] Filed: May 26, 1982

[30] Foreign Application Priority Data

Jun. 3, 1981 [JP] Japan ..... 56-084500

[51] Int. Cl.[3] ..... G03G 15/20

[52] U.S. Cl. ..... 355/3 FU; 355/14 FU; 430/124; 100/176; 100/171

[58] Field of Search ..... 355/3 FU, 14 FU, 3 TR, 355/14 TR; 118/651, 661; 430/124; 432/60, 228, 230; 100/176, 171

[56] References Cited

U.S. PATENT DOCUMENTS

| | | | |
|---|---|---|---|
| 4,104,963 | 8/1978 | Fortmann | 101/176 |
| 4,147,501 | 4/1979 | Goshima et al. | 355/3 FU X |
| 4,200,389 | 4/1980 | Matsui et al. | 355/3 FU |
| 4,272,666 | 6/1981 | Collin | 355/3 FU X |
| 4,290,691 | 9/1981 | Giorgini | 355/3 FU |
| 4,357,094 | 11/1982 | Zepko | 355/3 FU |

*Primary Examiner*—A. C. Prescott

*Attorney, Agent, or Firm*—Berger & Palmer

[57] ABSTRACT

A device for the pressure fixing of a toner image contains a pair of pressure fixing rolls arranged in parallel to each other. An image record carrier is fed in between said pressure fixing rolls which, for the pressure fixing of the toner image, are pressed against each other through a pressure bar by means of a plurality of pressure generators. Said pressure generators are positioned displaceably in the axial direction of said pressure fixing rolls to adjust a load distribution depending upon the width of said record carrier.

5 Claims, 7 Drawing Figures

PRESSURE FIXING DEVICE

BACKGROUND OF THE INVENTION

This invention relates to a pressure fixing device and in particular to a device for the pressure fixing of a toner image on an image record carrier in printing and copying systems. In printing and copying systems, there is employed electrophotographic recording apparatus which usually contains a photosensitive drum. An electrostatic latent image is developed by a well-known process on the surface of said drum. By applying a toner to said latent image, there is formed a toner image which is later fixed by means of a fixing device on a record carrier after said image has been transferred thereon.

For fixing devices of known types, heated rolls are utilized. Such devices have the disadvantage that a certain amount of heat-up time is necessary and are, susceptible to a risk of overheating which makes it difficult to ensure the safety for fixing operations. As a result, pressure fixing devices have recently been introduced to a significant extent for the fixing process. In the case of pressure fixing devices, it is necessary to apply pressing forces uniformly on a record carrier to fix a toner image thereon.

A known pressure fixing device having a pair of fixing rolls arranged axially in parallel to each other has the disadvantage that the device becomes large-sized if the diameters of the fixing rolls are increased in order to ensure a pressing force to be uniformly applied even as to different widths of a record carrier. On the contrary, it is a disadvantage that an uniform pressing force can not be obtained if said diameters are reduced, due to a bending deformation of said rolls under the load.

There is also known a pressure fixing device in which, for the purpose of ensuring a uniform pressing force, separate auxiliary pressure rollers are provided. Such a device has, however, the disadvantage that said auxiliary pressure rollers tend to damage the fixing rolls to which they are brought in contacting relation, whereby scratch marks are generated on the image record carrier.

A pressure fixing device of another configuration is known wherein fixing rolls are arranged in a slightly crossed manner with respect to each other. The diameters of said rolls can be reduced selecting the crossing angle. With the bending deformation of said rolls under the application of a load being taken into consideration, it is, however, of disadvantage for such a device that unnecessary stress exerted on a record carrier develops creases and cracks on the record carrier, since the rotating directions of said rolls and forwarding direction of said record carrier are inconsistent by virtue of the non-parallel arrangement of said rolls.

The fixing rolls used in the above-mentioned devices are supported each at both extremities thereof by means of bearings and are subject to a total amount of the load. Thus it has been found that the bearings tend to be damaged due to the excess load generated when an image record carrier is thick or is fed simultaneously with two or more sheets being overlapped, specifically in the case of fixing operations conducted under an elevated total load.

SUMMARY OF THE INVENTION

It is an object of the invention to provide an improved device for the fixing of a toner image. Another object of this invention is to provide a pressure fixing device having a plurality of displaceable pressure generators for applying pressing forces uniformly onto image carriers having different widths.

An additional object of this invention is to provide a small type pressure fixing device so structured as to avoid an undesired deformation of the image record carrier.

A pressure fixing device according to this invention has a pair of fixing rolls arranged axially in parallel to each other to which a load is applied through a pressure bar by means of a plurality of pressure generators for the pressure fixing of a toner image onto an image record carrier.

Said pressure generators are positioned displaceably in the axial direction of said fixing rolls so that a load distribution can be changed according to the width of a image record carrier.

For a better understanding of this invention, reference is made to the following detailed description of the invention given in connection with the accompanying drawings.

DESCRIPTION OF THE INVENTION

Figure 1:
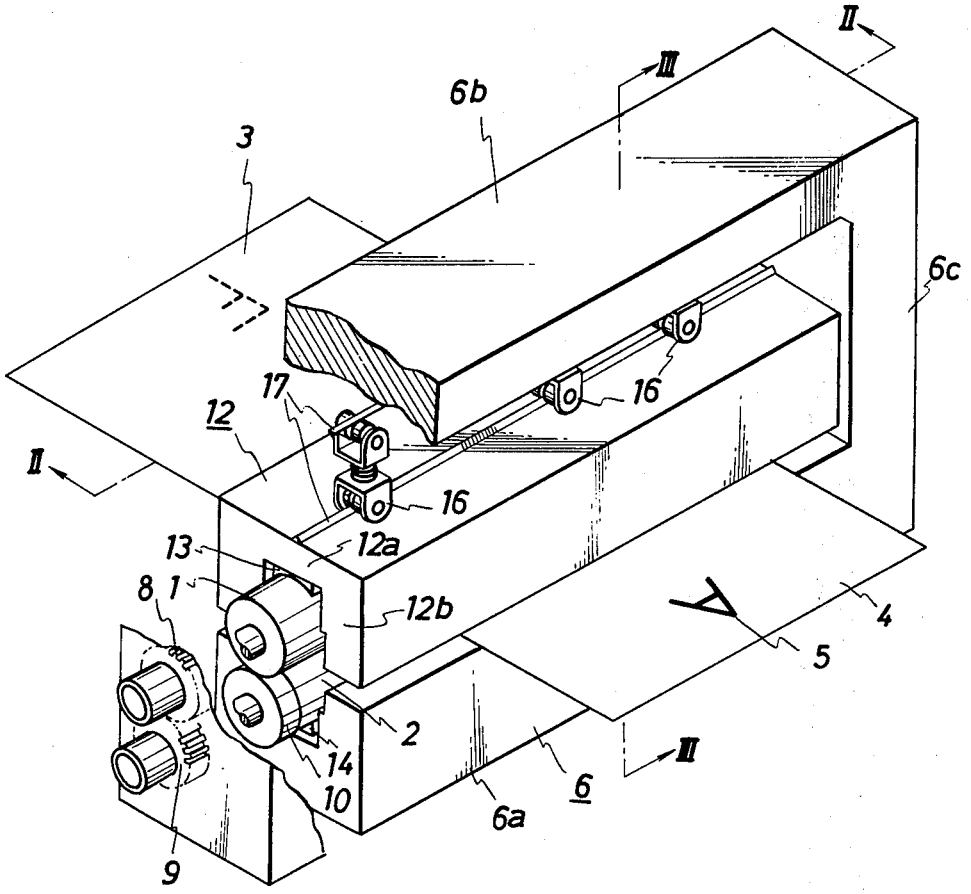
FIG. 1 is a perspective, partially cut-away view of a pressure fixing device according to the invention.
Figure 2:
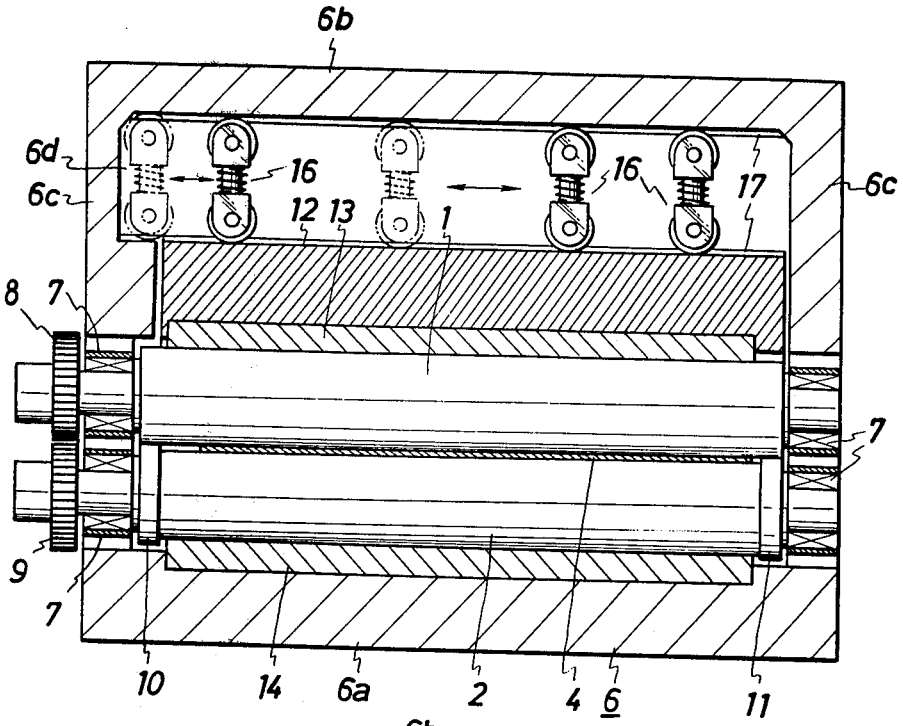
FIG. 2 is a sectional view on the II—II line of FIG. 1.
Figure 3:
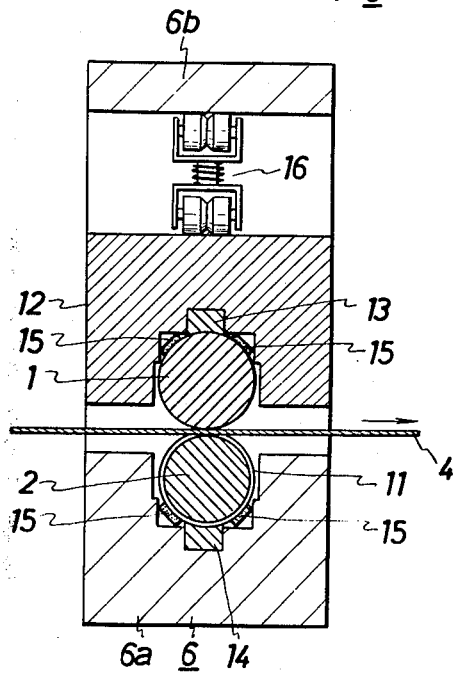
FIG. 3 is a sectional view on the III—III line of FIG. 1.

Referring now to FIGS. 1–3, there is shown a pressure fixing device according to this invention. The device has a pair of fixing rolls 1, 2 which apply pressing forces therebetween to an image record carrier 4 to fix a toner image 3 developed on said record carrier 4 as shown as 5. The record carrier may be a sheet of paper and a film. The fixing rolls 1, 2 are arranged axially in parallel to each other and are supported rotatably in a frame 6 at both ends thereof. It is recommended to support said rolls by means of bearings 7. One end of a fixing roll 1 is coupled with the corresponding end of the other fixing roll 2 by gears 8, 9 and said rolls 1, 2 are rotated simultaneously by a motor drive not shown here.

The lower fixing roll 2 has at both ends thereof flanges 10, 11 and a slight amount of air gap is provided with respect to the upper fixing roll 1. A preferred height of said flanges 10, 11 is approximately 10 μm as to a thickness of 75 μm of a record carrier 4. The flange 10 or 11 can be provided only to either of the upper roll 1 or the lower roll 2, while the lower roll 2 is provided with a flange as illustrated.

A pressure bar 12 comprises an upper wall 12*a* and double side walls 12*b* made of a metal and is accommodated in a housing formed by a frame 6. The pressure bar 12 is intended to apply a distributed load over the entire axial direction of the fixing rolls 1, 2 and is brought into contact with the upper roll 1. The lower part of upper wall 12*a* brought into contact with the upper roll 1 is provided with a sliding shoe 13 which is at its upper part incorporated into the upper wall 12*a* of pressure bar 12, is at its lower part brought into contact with a portion of the circumferential surface of upper roll 1 and extends lengthily over the axial direction thereof. The sliding shoe 13 is made of a material such as press mold product of a mixture of poliamid resin and fluorocarbon resin having a sliding property insusceptible of damaging the upper roller 1 which rotates.

In the same manner as said sliding shoe 13, an additional sliding shoe 14 is provided at the location symmetrically with respect to the fixing rolls 1, 2. Said sliding shoe 14 at its upper surface contacts the lower roll 2 and is incorporated into the lower block 6*a* of frame 6 formed in a symmetric relation to the pressure bar 12. The sliding shoe 13 receives from the pressure bar 12 a distributed load and transmits the latter to the upper roll 1 correspondingly. The sliding shoe 14 supports on its contacting surface the lower roll 2.

As shown in FIG. 3, the sliding shoes 13, 14 are provided individually on both sides thereof with a lubricating pad 15 extending slenderly over the axial direction of the fixing rolls 1, 2. To ensure a smoth contact of the sliding shoe 13, 14 with the fixing rolls 1, 2, silicon oil having lubrication and releasing properties is supplied from said lubrication pad 15. A plurality of pressure generators 16 are positioned in the space surrounded by the upper wall 6*b* and both side walls 6*c* of the frame 6 and the pressure bar 12. Said pressure generators 16 are arranged individually and displaceably in the axial direction of the fixing rolls 1, 2. The upper wall 6*b* of frame 6 and the pressure bar 12 are provided individually with a guide rail 17 extending in the axial direction of the fixing rolls 1, 2, and the pressure generators 16 are individually displaceable along said rails 17 in the directions of the arrows in FIG. 2. In displacing said pressure generators 16, it is possible to change a load distribution over the fixing roll 1 and to increase or decrease the total load. The pressure generators 16 will be described later in greater detail.

Now the functions of a pressure fixing device according to this invention will be described as follows:

If a load from a plurality of pressure generators 16, such as expansion forces of compressed springs are applied to the pressure bar 12, said load is applied as a distributed load to the sliding shoe 13, since said pressure bar is made of a type of metal of an appropriate stiffness. The sliding shoe 13 transmits said distributed load to the upper roll 1 and the distributed load thus applied to the upper roll 1 is then given as uniform pressures to a record carrier 4 passing through the fixing rolls 1, 2. By means of said pressures a toner image 3 is fixed on said record carrier 4 in such a manner as shown as a toner image 5.

There are different types as to the width of record carrier. According to the various widths the pressure generators 16 can be displaced individually. That is to say, if a wider record carrier is used, the pressure generators 16 are arranged with distances therebetween to ensure an uniform pressure distribution over the record carrier 4. To the contrary, in the case of a narrow record carrier, the number of the pressure generators 16 can be reduced and they are spaced appropriately with each other. In reducing the number of said pressure generators 16, it is convenient to provide a refuge 6*d* within the left side wall 6*c* of frame 6 as shown, by way of example, in FIG. 2 and to accommodate the pressure generator 16 on the left side inside the refuge 6*d*.

A driving mechanism to displace pressure generators 16 will be described later in greater detail. Even if a record carrier is thick or is forwarded between the fixing rolls 1, 2 with two sheets being overlapped on one another, said rolls increase the gap therebetween by keeping the same parallel relation to each other and without generating bending deformations. This is accomplished by means of bearings 7 which support the fixing rolls 1, 2, whereby said bearings are provided within their boxes with a small amount of play in the vertical direction as shown in FIG. 2.

Also in the embodiment as shown, a small amount of air gap is defined between the fixing rolls 1, 2 by flanges 10, 11 at both ends of the fixing roll 2. In this manner, the record carrier 4 is not excessively pressed at both edges thereof when passing between the fixing rolls 1, 2—a fact which prevents the record carrier from becoming translucent at their edges. Under ordinary circumstances, it is not necessary to provide the fixing rolls specifically with the flanges.

Figure 4:
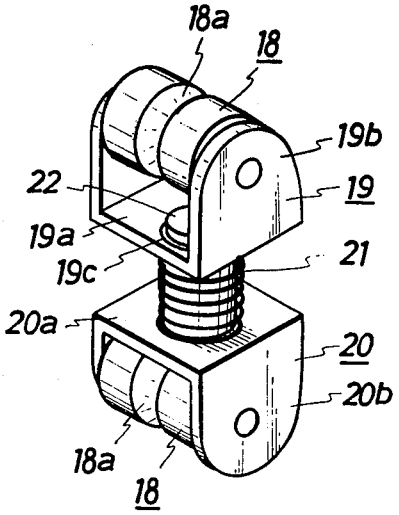
FIG. 4 shows an embodiement of a pressure generator used in a pressure fixing device according to this invention.

FIG. 4 illustrates an embodiment of a pressure generator 16 comprising two locomotion rolls 18, members 19, 20 supporting rotatably said rollers 18 and a compressed coil spring 21 applying a load to the supporting members 19, 20.

A locomotion roller 18 is formed by a metal and has a V-shaped slot 18*a* which is brought into engagement with a guide rail 17 as shown in FIG. 1. With said slot 18*a* engaging the guide rail 17, the turning off of a pressure generator 16 from the predetermined truck is prevented when the pressure generator 16 is displaced.

The upper supporting member 19 comprises a bottom plate 19*a* and double side plates 19*b*, with said bottom plate 19*a* having an aperture 19*c* therethrough. Similarly, the lower supporting member 20 comprises a bottom plate 20*a* and double side plates 20*b*. A post 22 about which the compressed coil spring 21 is placed is fixed to the bottom plate 20*a*. Said post 22 passes through the aperture 19*c* of the bottom plate 19*a* with a certain amount of looseness, rendering the rollers 18 to displace up and down on a vertical line.

The pressure generator so structured makes it possible for an expansion force of the compressed coil spring 21 to be applied through the supporting members 19, 20 and through the locomotion roller 18 up to the pressure bar 12 as a load as shown in FIG. 1.

Figure 5:
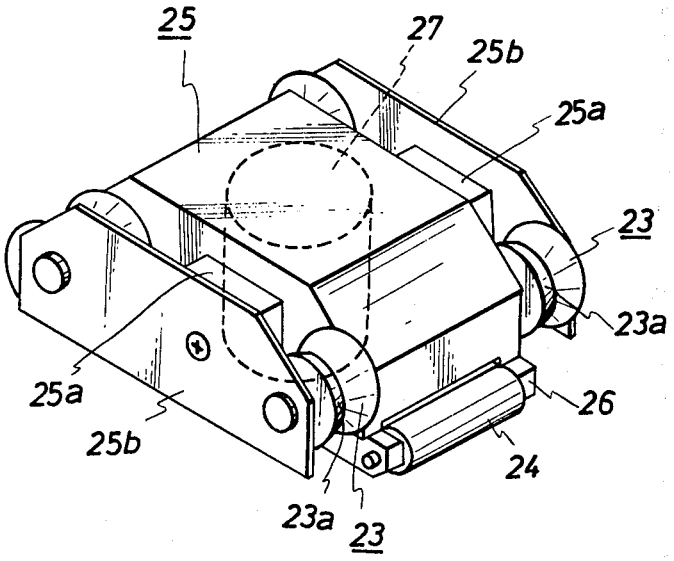
FIG. 5 illustrates another embodiement of a pressure generator.
Figure 6:
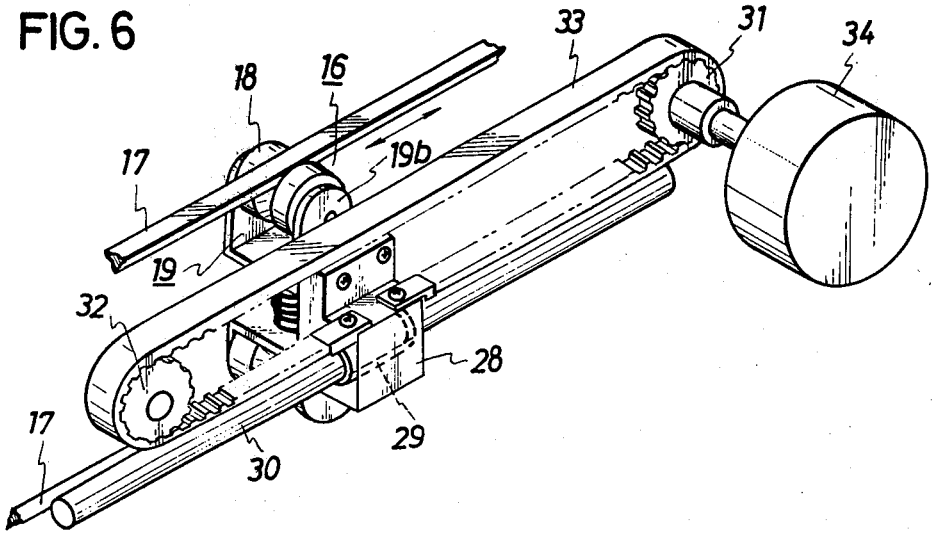
FIG. 6 describes a mechanism to displace a pressure generator.

In FIG. 5, there is illustrated another embodiment of a pressure generator which comprises four upper locomotion rollers 23, two lower locomotion rollers 24, an upper block 25 supporting rotatably said rollers 23, a lower block 26 supporting rotatably said rollers 24 and a compressed coil spring 27 exerting a load on said blocks 25, 26. The upper block 25 contains on its inside a chamber accommodating the compressed coil spring 27 and has on both sides thereof side plates 25*b* fixed to fittings 25*a*. The upper rollers 23 are supported individually and rotatably between the body of upper block 25 and the side plates 25*b*. In the same manner as the embodiment of FIG. 4, the upper rollers 23 have a V-shaped slot 23*a* respectively. Said V-shaped slots 23*a* are brought into engagement with both guide rails provided underneath the upper wall 6*b* of frame in FIG. 1 in such a way that two rollers aligned on each side engage a corresponding rail. The lower rollers 24, cylindrical in shape, are axially elongated and supported individually and rotatably both in the front and in the rear of the lower block 26. The upper block 25 and the lower block 26 are formed in part in a telescopic configuration to render the upper and lower blocks 25, 26 to be displaceable up and down without moving sideways under the expansion force of the compressed coil spring 27. This embodiment has an advantage of increased stability as against the FIG. 4 embodiment. FIG. 6 is a view descriptive of a motor drive to displace a pressure generator 16. A pressure generator 16 engages the upper and lower guide rails 17 through its upper and lower locomotion rollers 18 and is oriented in the displacement directions. A side plate 19*b* of the upper supporting member 19 is fixed to a guide block 28 by means of screws or the like. The guide block 28 is associated with a guide shaft 30 over a linear ball bearing 29 and is made displaceable along the guide shaft 30. A synchronizing belt 33 suspended on a drive pulley 31 and an idle pulley 32 is at both ends thereof fastened to the guide block 28 by means of screw or the like. The drive pulley 31 is coupled to a driving motor 34 destined for this particular purpose.

When it is necessary to displace a pressure generator depending upon the size of width of an image record carrier, the motor 34 is driven towards a rotation direction as desired by an electric signal. The driving force of motor 34 is transmitted to the synchronizing belt 33 through the drive pulley 31. Since both ends of synchronizing belt 33 are fastened to the guide block 28 fixed to the pressure generator 16, the latter moves together with said guide block 28 in the directions of the arrows. Other pressure generators are displaceable by similar driving mechanisms using individually a particular motor.

In the embodiment of FIG. 2, the right edge of a record carrier 4 is placed closely at a flange 11 of the lower fixing roll 2 and load positions are defined on the basis of the right side. Therefore the leftmost pressure generator 16 is displaced, while it is convenient to displace the rightmost pressure generator 16 when the forwarding movement of record carrier 4 is effected on the basis of the left side. In case of setting the load positions on the basis of the middle pressure generator, it is also convenient to allocate the other pressure generators towards the right and the left with respect to the middle pressure generator. Thus it is possible to apply uniform pressing forces through the change of a load distribution by properly allocating the pressure generators depending upon the width of record carrier.

Figure 7:
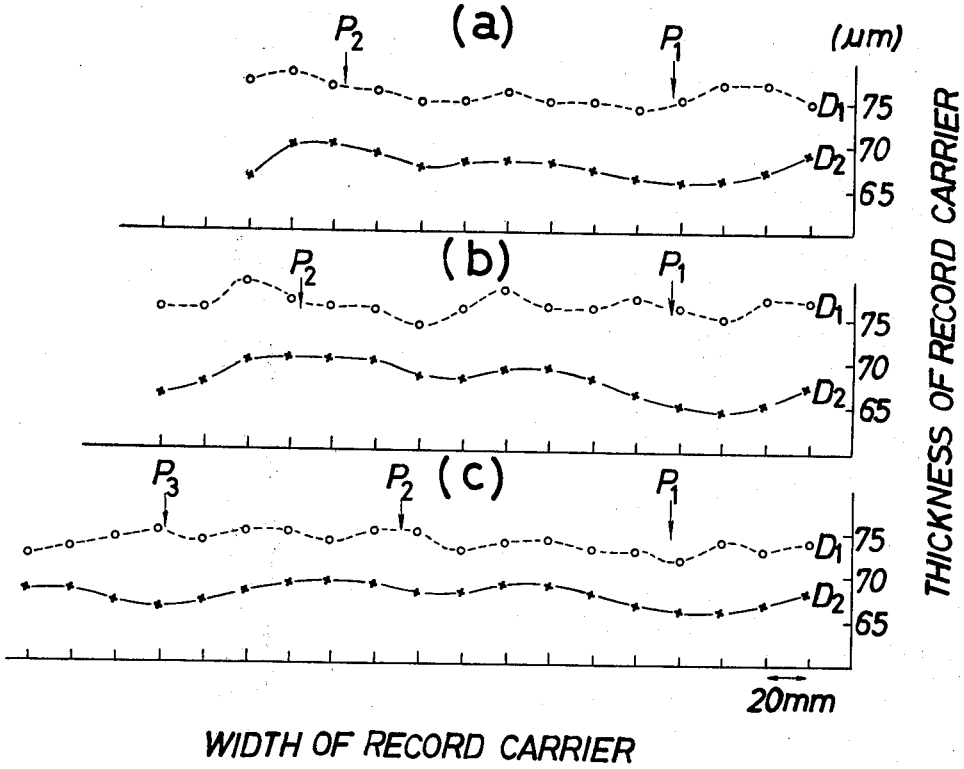
FIG. 7 is diagrams indicating thickness values of record carrier measured prior to the fixing of toner images on the record carriers using a pressure fixing device according to this invention as against those measured subsequent to the fixing operation.

FIG. 7 illustrates the resulting values of thickness of record carriers having different widths, measured before and after a pressure fixing process. The results obtained for a paper sheet having a width of 26 cm are indicated in (a), those for paper sheets measuring 30 cm and 36 cm in width are shown in (b) and (c) respectively. $P_1$, $P_2$ and $P_3$ represent the load positions or the locations of pressure generators set on the basis of the right side as described in the FIG. 2 embodiment. Each pressure generator is designed for developing a load of 200 kg. $D_1$ is the thickness of a paper sheet before the pressure fixing process, while $D_2$ represents the thickness of the same thereafter. For the measurements, a pair of fixing rolls having a diameter of 20 cm were used, of which surfaces are hardened at $H_RC$ 63 (Rockwell hardness C scale) and are polished after having been plated with hard chromium.

As is evident in this figure, the position $P_2$ of left pressure generator is displaced toward the left because of a larger width of the paper sheet in (b) than that in (a), although the total load remains unchanged. In the case of (c) in which the width of paper sheet is further increased, three pressure generators are implemented to achieve an addition to the total load and two pressure generators on the left side are moved to $P_2$, $P_3$ to ensure uniform pressing forces to be applied over the paper sheet. This will be understood with ease, if a pressure generater indicated by a double dotted chain line in FIG. 2 is referred to. Commonly to all the cases, the thickness $D_1$ of paper prior to the pressure fixing process is found to be not uniform in the width direction. If the thickness $D_2$ of paper subsequent to the fixing process is observed with this point in mind, $D_2$ is found to fluctuate in a stable manner across the paper. This means that a plurality of pressure generators ensures almost uniform pressing forces over the paper by means of the displacements of pressure generators depending upon the width of the paper.

A pressure fixing device according to this invention has the advantages described below:

The device can be miniaturized by using fixing rolls of a smaller diameter, since uniform pressing forces over an image record carrier are accomplished by selecting the positions of pressure generators according to the width of said record carrier.

Due to the fact that a load is applied through the pressure bar to the entire upper fixing roll is the form of a distributed load, an elastic bending deformation of the upper fixing roll becomes out of question and an attempt to improve the stiffness thereof through an increased diameter of each fixing roll becomes no more necessary.

The availability of fixing rolls of reduced diameters permits a narrowed nip width, thereby enabling the pressing duration to be shortened accordingly. When a paper sheet is used as a record carrier, the original thickness thereof is not recovered and the resultant thickness is reduced ever when the paper is released from the pressing forces once the elasticity of paper fibers has been lost. With the amount of a decrease in the paper thickness proportional to a product of the pressing forces by the pressing duration, the elasticity of paper fibers is preserved by reducing the pressing duration. And the change of paper thickness is maintained to a minimum extent. All this contributes to preventing an undesired deformation or the development of translucency from occurring of a paper sheet.

The pressing forces between the fixing rolls which are disposed axially in parallel to each other and one upon another is inversely proportional to the square root of the diameters of rolls when a load is applied thereto.

Assuming that the fixing pressure is constant, the less the total load can be provided, the less the roll diameters are dimensioned. If the total load is reduced, the bearings which rotatably support said rolls can never be damaged. Specifically if such bearings as having a small amount of play within the bearing boxes are used, the fixing rolls are displaced by keeping the parallel relation to each other to cope with such changes in the thickness of record carrier as resulting, for example, from overlapped record carriers, while following up the letter without causing an undesirable deformation thereto.

In the case of embodiment wherein both ends of one of the fixing rolls are provided with flanges, both edges of a record carrier are not subject to excessive pressing forces which otherwise cause the record carrier to become translucent at both edges.

Since the distributed load is applied to the upper fixing roll through a sliding shoe made of an appropriate material having a sliding property, said roll neither can be damaged nor can generate cracks on the record carrier. A pair of fixing rolls are disposed axially in parallel to each other—an arrangement which prevents the record carrier from creasing or being damaged. Based on the experiments conducted as to paper of a weight ranging from 45 kg to 130 kg per ream, it has been confirmed that the pressure fixing device is capable of accomplishing the pressure fixing of a toner image properly without developing an undesired deformation of the record carrier.

It will be understood that the above description is as merely illustrative of the invention and not as restrictive thereof. And if goes without saying that the invention may be modified without departing from the scope and spirit of the invention.

What is claimed is:

1. A device for the pressure fixing of a toner comprising a pair of fixing rolls arranged axially in parallel to each other, said rolls fixing a toner image on an image record carrier by applying pressing forces to said record carrier between said rolls, a frame supporting individually and rotatably the axles of said rolls and forming a housing, a pressure bar giving a distributed load to said fixing rolls, and a plurality of pressure generators disposed within a space formed by said frame and said pressure bar, said pressure generators giving pressing forces to said pressure bar and being arranged displaceably in the axial direction of said rolls depending upon the width of said image record carrier.

2. A pressure fixing device as set forth in claim 1, wherein said pressure bar and said frame are individually provided with a sliding shoe in such a way that the circumferential surface of each of said rolls is brought into contact with said sliding shoe.

3. A pressure fixing device as set forth in claim 1, wherein both ends of either of said fixing rolls in pair is provided individually with a flange so that an air gap is formed between said fixing rolls.

4. A pressure fixing device as set forth in claim 1, wherein said pressure generator comprises a plurality of locomotion rollers, members supporting said rollers and a compressed spring giving a load to said supporting members.

5. A pressure fixing device as set forth in claim 1, wherein a refuge is formed inside a side wall of said frame so that such a pressure generator as may become unnecessary can be accommodated therein.

* * * * *